United States Patent [19]

Chawla et al.

[11] Patent Number: 4,638,712

[45] Date of Patent: Jan. 27, 1987

[54] BULLET PERFORATING APPARATUS, GUN ASSEMBLY AND BARREL

[75] Inventors: Manmohan S. Chawla; Junius L. Speights, both of Houston, Tex.

[73] Assignee: Dresser Industries, Inc., Dallas, Tex.

[21] Appl. No.: 690,701

[22] Filed: Jan. 11, 1985

[51] Int. Cl.[4] ..... E21B 43/116

[52] U.S. Cl. ..... 89/1.15; 42/77; 175/4.57

[58] Field of Search ..... 102/444; 42/77, 76 A; 89/1.15, 16; 175/4.57, 4.58, 4.59; 166/55

[56] References Cited

U.S. PATENT DOCUMENTS

| | | | |
|---|---|---|---|
| 640,070 | 12/1899 | Aeschbacher | 42/77 |
| 969,011 | 8/1910 | Vedder | 42/77 |
| 1,127,268 | 2/1915 | Malster | 42/77 X |
| 1,517,328 | 12/1924 | Weiss | 42/77 |
| 1,599,651 | 9/1926 | Corson | 42/77 |
| 2,125,487 | 8/1938 | Church | 89/1.15 X |
| 2,212,045 | 8/1940 | Ridley | 89/1.15 X |
| 2,262,925 | 11/1941 | Cole | 89/1.15 X |
| 2,266,345 | 12/1941 | Turechek | 89/1.15 X |
| 2,362,738 | 11/1944 | Yarbrough | 89/1.15 X |
| 2,436,118 | 2/1948 | Neal | 89/1.15 X |
| 2,591,319 | 4/1952 | Tow | 175/4.58 |
| 2,664,156 | 12/1953 | Allen | 175/4.57 X |
| 2,667,712 | 2/1954 | Hunting et al. | 42/77 |
| 2,792,657 | 5/1957 | Slowter | 42/76 A |
| 3,118,243 | 1/1964 | Manshel | 42/76 A |
| 3,367,429 | 2/1968 | Porter | 175/4.58 |
| 3,742,640 | 7/1973 | Thomsen | 42/76 A |
| 4,123,866 | 11/1978 | Wiethoff | 42/77 |
| 4,435,455 | 3/1984 | Prewo et al. | 42/76 A |

OTHER PUBLICATIONS

"Perforating Technology", Dresser Industries, Inc., pp. 2-1 through 2-8.

*Primary Examiner*—David H. Brown
*Attorney, Agent, or Firm*—Patrick H. McCollum

[57] ABSTRACT

A bullet perforating apparatus for perforating subsurface formations traversed by a borehole. The bullet perforating apparatus comprises a gun body with a plurality of bullet perforating gun assemblies. The individual gun assemblies further comprise a gun barrel, a cartridge tube with propellant, means for igniting propellant, a projectile, and a seal at the well bore end of the barrel. The barrel further comprises an outer member and a replaceable wear member securely retained within the outer member.

5 Claims, 2 Drawing Figures

BULLET PERFORATING APPARATUS, GUN ASSEMBLY AND BARREL

BACKGROUND OF THE INVENTION

This invention relates generally to subsurface well perforating apparatus and, more specifically to bullet perforating guns and a means for extending the useful life of the barrels used in these guns.

It has become common practice in the completion of oil and gas wells to perforate the well casing and the surrounding formations to bring a well into production. Bullet perforating guns have long been used for this purpose, especially in perforating formations of low compressive strength.

One of the major problems in the use of bullet perforating guns has been wear to and expansion of the barrels which results in "blow-bys" of the propellent gas, thereby reducing the bullet velocity and degrading the bullet performance. Eventually this wear and expansion renders the barrel useless, whch means that the barrel must discarded.

This and other disadvantages are overcome by the present invention which provides a relatively inexpensive wear member that is inserted into a relatively expensive outer member to form the barrel. This wear member reduces the wear to and expansion of the outer member, thereby extending the useful life of the outer member. The wear member can also be inserted into a previously worn or expanded outer member, thereby rehabilitating this outer member for further use.

SUMMARY OF THE INVENTION

In a preferred embodiment of the invention, a bullet perforating apparatus is provided which, in its overall concept, includes a perforating gun body with a plurality of bullet perforating gun assemblies. This apparatus is adapted to be lowered into a well bore attached to the end of a single or multi-conductor cable. Each individual gun assembly has a bullet perforating gun barrel, a cartridge tube adjacent to the inner end of the barrel accomodating a quantity of propellant, a means for igniting the propellant, a projectile placed within the barrel adjacent to the cartridge tube, and a seal engaged to the well bore end of the barrel. The bullet perforating gun barrel has an outer member threadably attached to the gun body and a replaceable wear member retained within the outer member. This wear member reduces wear to and expansion of the outer member thereby extending the useful life of the outer member. The wear member can also be inserted into a previously worn outer member thereby rehabilitating it for further use.

These and other features and advantages of the present invention will be more readily understood by those skilled in the art from a reading of the following detailed description with reference to the accompanying drawings.

DETAILED DESCRIPTION OF THE PREFERRED EMBODIMENT

Figure 1:
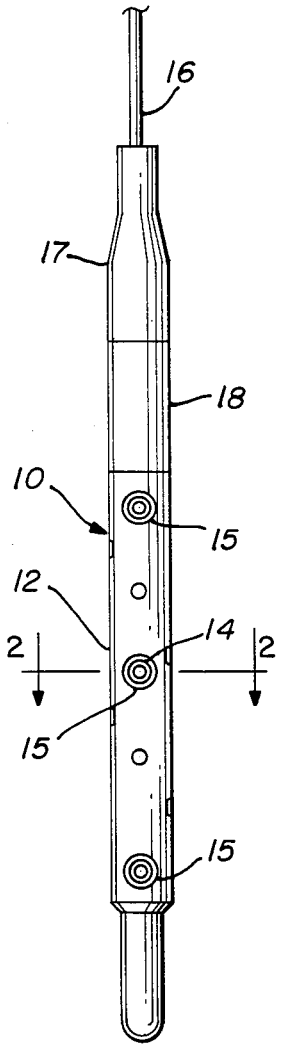
FIG. 1 is an elevational view of a typical bullet perforating gun apparatus embodying the features of the present invention.

Referring now to the drawings in more detail, particularly to FIG. 1, there is illustrated a bullet perforating gun apparatus 10 in accordance with the present invention. Apparatus 10 is comprised of a generally cylindrical tubualar gun body 12 having a plurality of individual bullet perforating gun assemblies 14 retained within apetures 15. In the preferred embodiment apparatus 10 is adapted to be lowered into a well bore attached to the end of a single or multiconductor cable 16 and cablehead assembly 17. Gun body 12 is preferably, but not limited to, a generally elongated substantially solid steel cylinder of sufficient strength and solidity to withstand the pressures generated by the firing of gun assemblies 14, such as the gun body of the commercially available Dresser Atlas E-Gun Bullet Perforator.

As indicated in FIG. 1, between apparatus 10 and cablehead assembly 17 is a sub 18 which may include a firing head assembly or some other related device. These subs are well known in the art and are not part of the present invention.

Figure 2:
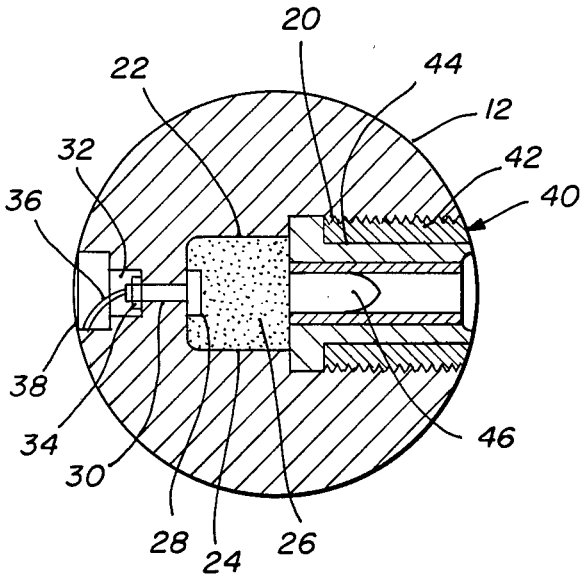
FIG. 2 is a cross-sectional view along the line 2—2 of a typical bullet perforating gun assembly embodying the features of the present invention.

Referring now to FIG. 2, there is illustrated a cross-sectional view taken along the lines 2—2 of a typical bullet perforating gun assembly embodying the present invention. The actual construction of the gun assembly may vary depending upon the type of use and downhole conditions encountered, for example, different bullets are used for perforating different formations, gun barrel length may vary for different propellants, and propellant composition and placement may vary upon the downhole temperature. None of these variants, however, are restrictive of the invention disclosed herein.

Gun body 12 is provided with apeture 15 comprising laterally extending coaxial bores 20 and 22. The smaller diameter bore 22 extends innermost and forms the propellant chamber. Positioned within bore 22 is a cartridge tube 24 containing a quantity of propellant 26. As mentioned before, the composition of propellant 26 is dependent upon the type of use and downhole conditions encountered, and is not restrictive of the invention herein described. An igniter 28 extends into the rear of cartridge tub 24, and a tubular member 30 extends from the rear of igniter 28 into a chamber 32. Tubular member 30 is secured to the inner wall of chamber 32 by a nut 34. A cord 36 for igniting the igniter extends from a firing device into chamber 32, through tubular member 30, into igniter 28. Cord 36 may be an electrical wire, a quantity of primacord, or other means for igniting the igniter depending upon the method used for actuating the perforating apparatus; once again this is not restictive of the present invention. A seal 38 is engaged with the wall of chamber 32 to form a seal for chamber 32 to prevent the entrance of well bore fluids into gun assembly 14.

The cylindrical wall of outer bore 20 is formed into female threads to engage with the male threads of a generally tubular barrel member 40. Barrel member 40 comprises an outer member 42 having a bore therethrough and a replaceable wear member 44 retained within this bore therethrough, the diameter of this bore being approximately equal to the outer diameter of the projectile to be used. The type of projectile, and therefore the diameter of the bore of wear member 44, may vary depending on factors such as the type of propellant used. None of these variants, however, are restrictive of the invention herein disclosed. The inner portion of wear member 44 has an extended diameter which overlaps the inner end of outer member 42 to prevent lateral movement of wear member 44 upon the firing of gun assembly 14.

Wear member 44 is comprised of a material or combination of materials having a sufficient melting point, hardness, corrosion resistance and yield strength to withstand the temperatures and pressures generated by the firing of gun assembly 14. A variety of materials meet these requirements such as common available high strength tool steel with chrome plating on the interior surface.

In the preferred embodiment wear member 44 is a low thermal expansion ceramic, such as $Al_2O_3$, WC, W or TiC, surrounded by a layer of shape memory material, such as NITINOL. Wear member 44 is constructed in such a fashion that the tensile stresses developed in the ceramic during the firing of gun assembly 14 are effectively cancelled out by the compressive stresses placed on the ceramic by the shape memory material. This cancellation of the tensile stresses effectively nullifies barrel expansion, thereby extending the useful life of the outer members to a maximum.

A projectile 46 is placed in the bore of wear member 44 adjacent to cartridge tube 24. Projectile 46 is generally a hardened steel bullet of sufficient strength to resist shattering upon striking the well bore casing. A seal 48 is engaged with the outer end of barrel member 40 to form a seal to prevent the entrance of well bore fluids into gun assembly 14.

Many modifications and variations besides those specifically mentioned may be made in the techniques and structures described herein and depicted in the accompanying drawings without departing substantially from the concept of the present invention. Accordingly, it should be clearly understood that the form of the invention described and illustrated herein is exemplary only, and is not intended as a limitation on the scope of the present invention.

The embodiments of the invention in which an exclusive property or privilege is claimed are defined as follows:

1. A bullet perforating gun for use in a borehole traversing subsurface earth formations, comprising:

an elongated gun body member adopted to traverse a borehole, said body member including a plurality of lateral apetures therein, said apetures having a threaded portion thereof;

a plurality of replaceable barrel members, each of said barrel members having an axis of perforation generally perpendicular to the longitudinal axis of said gun body member and consisting of a first tubular member of low thermal expansion ceramic material, said first tubular member having a longitudinal bore therethrough for closely passing a protectible therethrough, and a second generally tubular member of shape memory material coaxially disposed about said first tubular member, said second member having an enlarged outer diameter base portion; and an outer member for each said barrel members coaxially disposed about said second member and threadably engagable into said apertures within said gun body member, said outer member abutting said enlarged outer diameter base portion of said second member for retaining said second member within said gun body member.

2. The bullet perforating gun of claim 1 further comprising:

a quantity of propellant located within each of said apetures proximate said barrel members; and an ignitor for igniting said propellant.

3. The bullet perforating gun of claim 2 wherein said ceramic material further includes a material selected from the group consisting of tungsten, aluminum oxide, tungsten carbide, and titanium carbide.

4. The bullet perforating gun of claim 3 further comprising a hardened steel bullet said bullet sized for passage through said longitudinal bore in said first tubular member for perforating said earth formations.

5. The bullet perforating gun of claim 4 further comprising a fluid occlusive seal at the borehole end of said member.

* * * * *